US006722595B1

(12) United States Patent
Frick et al.

(10) Patent No.: US 6,722,595 B1
(45) **Date of Patent: *Apr. 20, 2004**

(54) KNIFE FOR DISK CHIP CUTTING MACHINES

(75) Inventors: Anders Frick, Iggesund (SE); Mats Engnell, Iggesund (SE)

(73) Assignee: Iggesund Tools AB, Iggesund (SE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/765,267

(22) PCT Filed: Apr. 19, 1995

(86) PCT No.: PCT/SE95/00427

§ 371 (c)(1),
(2), (4) Date: Dec. 20, 1996

(87) PCT Pub. No.: WO96/00639

PCT Pub. Date: Jan. 11, 1996

(30) Foreign Application Priority Data

Jun. 29, 1994 (SE) ..... 9402310

(51) Int. Cl.[7] ..... B27G 13/08; B27L 11/00; B02C 18/18

(52) U.S. Cl. ..... 241/92; 241/298; 144/218; 144/241; 407/114; 407/116

(58) Field of Search ..... 83/592; 144/114.1, 144/176, 218, 235, 241, 359; 241/92, 278.1, 292.1, 296, 298

(56) References Cited

U.S. PATENT DOCUMENTS

| | | | | | |
|---|---|---|---|---|---|
| 4,047,670 | A | * | 9/1977 | Svensson | 241/92 |
| 4,164,329 | A | * | 8/1979 | Higby | 241/296 X |
| 4,269,244 | A | * | 5/1981 | Kinsella | 144/218 |
| 4,545,413 | A | | 10/1985 | Sundberg et al. | 144/176 |
| 4,669,516 | A | | 6/1987 | Carpenter et al. | 241/92 X |
| 4,694,995 | A | * | 9/1987 | Holmberg et al. | 241/92 |
| 4,754,789 | A | * | 7/1988 | Jonsson | 241/92 X |
| 5,183,089 | A | * | 2/1993 | Norlander et al. | 144/241 X |
| 5,348,065 | A | * | 9/1994 | Meyer | 144/241 X |
| 5,564,967 | A | * | 10/1996 | Jorgensen | 451/45 |

FOREIGN PATENT DOCUMENTS

| | | |
|---|---|---|
| AT | 397629 | 5/1994 |
| DE | 1106483 | 5/1961 |
| SE | 448842 | 3/1987 |

* cited by examiner

*Primary Examiner*—Clark F. Dexter
(74) *Attorney, Agent, or Firm*—Fitzpatrick, Cella, Harper & Scinto

(57) ABSTRACT

A knife for a disk chip cutting machine which is mounted between a carrier part and a clamping part and which includes a chip breaking surface extending into an opening adjacent an outer surface of the carrier part. The chip breaking surface includes a concave portion which terminates in a rib which extends outwardly and downwardly with respect to an interface between the knife and the carrier part with the concave portion being oriented to direct cut chips in a direction away from the outer surface of the carrier part during use.

5 Claims, 1 Drawing Sheet

KNIFE FOR DISK CHIP CUTTING MACHINES

BACKGROUND OF THE INVENTION

1. Field of the Invention

The present invention relates to a knife for disk type chip cutter machines with a circular rotatable cutter disk on its first axial side being provided with several knives running from the disk center to its periphery and an opening being provided in the disk in connection with each knife. The opening having a chip guiding surface to guide separated chips to the other axial cutter disk side and the knife comprises a knife carrier, on which the knife is fixed between a first carrier part provided essentially in line with the first axial cutter disk surface and a second carrier part extending downwards in the opening from said cutter disk surface into the cutter disk inside and being a part of the chip guiding device.

2. History of the Related Art

In such knives with the knife fixed between two parts, one of which serves as a chip guide through the opening in the cutter disk, a fast and heavy wear occurs of said last mentioned part, when the chips are hitting the part and when hard impurities accompanying the chips are hitting the part.

Several attempts have been made to solve this problem by means of exchangeable wear plates provided at the carrier part as part of the chip guide. All so far known devices, however, involve an increased cost during manufacturing and during an exchange of worn parts.

OBJECT OF THE INVENTION

The main objective of the present invention is to provide a knife, where the problems of the guiding surface wear is solved in a simple and economical way.

This and other objectives of the invention are achieved by providing it with the characteristics specified in the claims which follow.

BRIEF DESCRIPTION OF THE DRAWINGS

The invention will be described hereinafter more in detail in connection with the accompanying drawing, where.

DESCRIPTION OF THE PREFERRED EMBODIMENT

Figure 1:
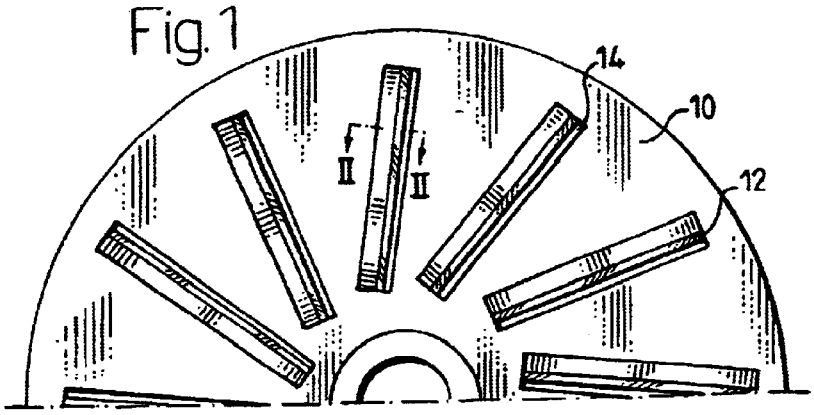
FIG. 1 shows a plane view of a part of a cutter disk with inserted knives.

In FIG. 1 a part of a cutter disk 10 is shown, mounted on which are several knives 12 extending from the disk's 10 center towards its circumference. Connected with each knife are openings 14 in the disk, through which the cut chips pass from the disk's 10 one axial surface to its opposite surface.

Figure 2:
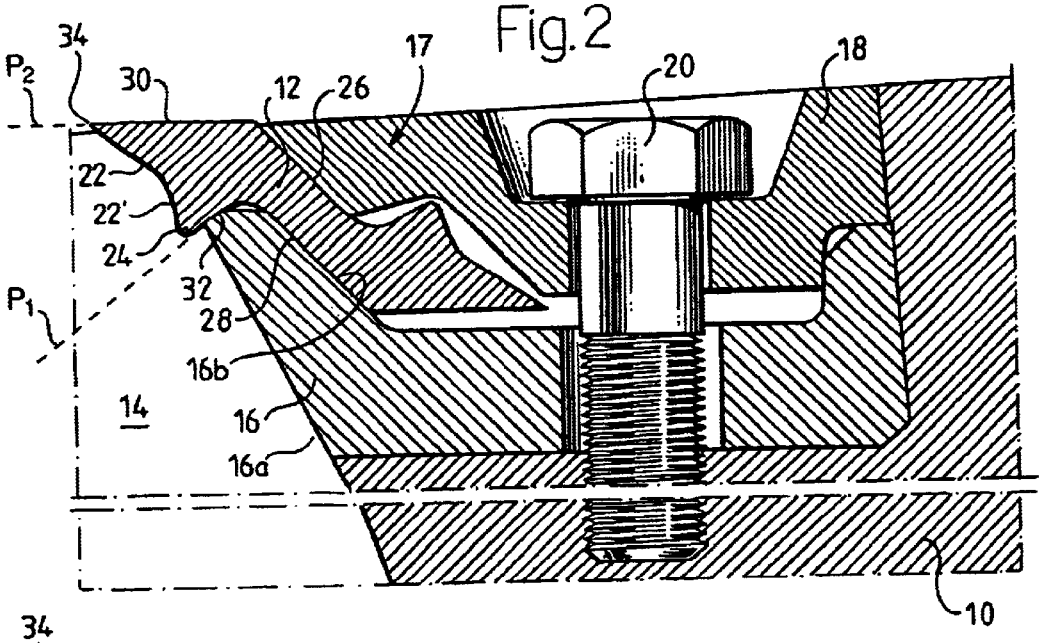
FIG. 2 shows a section through a knife according to the invention along line II—II in FIG. 1.
Figure 3:
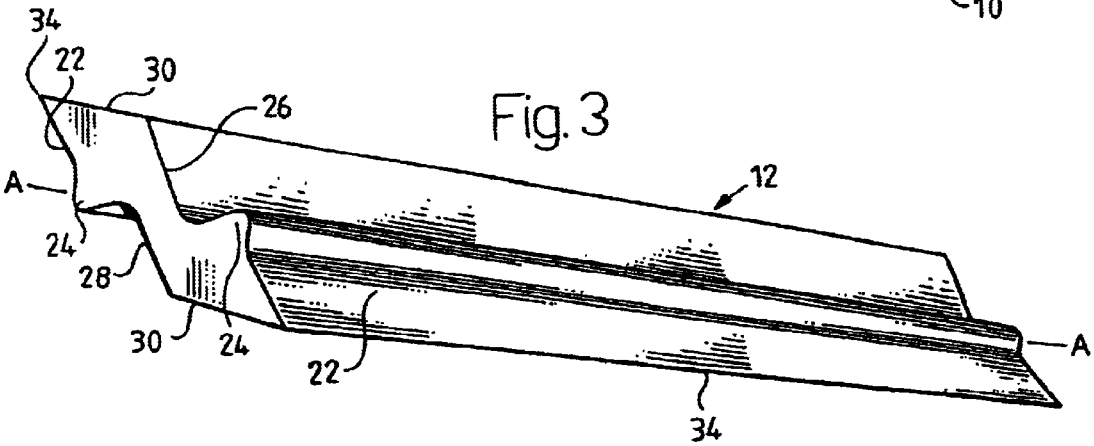
FIG. 3 is a perspective view of the knife of the invention.

In FIG. 2 the knife according to the invention is shown in section illustrating the fixing of the knife 12 in a cartridge or knife holder 17 arranged in a recess in the cutter disk 10. The cartridge consists of a carrier part 16 and a fixing or clamping part 18 keeping the knife fixed between them by means of a bolt 20 passing through openings in the cartridge parts 16 and 18, respectively. Normally, the lower carrier part 16 of the cartridge also provides the chip guide and is thus exposed to heavy wear resulting in an exchange with relatively small intervals. This part 16 due to its function as a carrier part having a special form requiring a machining during manufacturing is relatively expensive and the need to change this part within small intervals increases the service costs for the cutter.

According to the invention, another way is shown to solve the described problem. The knife 12 being preferably reversible is of course exposed to a heavy wear and is thus reversed and exchanged, respectively, to be reground or changed. To minimize the chip chocks against the lower carrier part 16, particularly the outer surface 16*b* thereof and the wear of it, the knife 12 according to the invention is provided with a chip breaking surface 22 guiding the cut chips in a direction away from the carrier part 16, particularly the outer surface 16*b* thereof and from the cutter disk's 10 underlying surface. For example, chip breaking surface 22 is provided with a chip directing portion 22' that forms a rib or a protrusion 24 extending beyond the carrier part 16 into opening 14 when the knife 12 is in a fixed position in the cartridge, so that the chips or splinters definitely receive a motion direction leading away from the carrier part 16 and the cutter disk 10.

As shown in FIG. 2 the knife 12 has two parallel plane contact surfaces 26, 28 in contact with corresponding surfaces on the carrier part 16 and the fixing part 18 to fix the knife into the cartridge. The knife edge or cutting edge 34 is provided by a plane outer surface or knife edge forming surface 30 essentially coinciding with the cutter disks' 10 axial surface, and the previously described chip breaking surface 22—in the execution example here shown first running straight and thereafter changing into a slightly concave shape to provide the guide surface 22' for the chips or splinters. The chip breaking surface 22 is, by means of the rib 24, connected or interfaced to a plane knife support surface 32 supported by a corresponding surface of the carrier part 16 providing a support for the knife 12 when under load. It should be noted that the plane surface 32 is not parallel to plane surface 30 such that the chip directing surface 22' of the rib 24 diverges outwardly along a plane $P_1$ from a plane $P_2$ which coincides with the surface 30 so that cut chips are directed away from the carrier part 16. In this manner, the plane $P_1$ defined by the rib 24 extends transversely with respect to the plane $P_2$. The knife 12, is as mentioned, reversible in that it is symmetric around an elongated axis A-A parallel to the knife edges and situated centrally inbetween these, the knife then being identically uniform after it is reversed by a half a turn around said axis.

By providing a chip breaking surface 22 according to the invention on the knife 12 itself large savings are made in the service costs, in that the cartridge carrier part 16 and the cutter disk 10 to a grat extent are protected against wear. The wear thus occurs on the knife surface, 22 and 22', this being of minor importance, as the knife 12 in any case has to be reversed or changed, when the edge becomes dull.

Evidently the embodiment shown and described above is only one example of the implementation of the invention and this can be changed and modified within the scope of the claims which follow.

What is claimed is:

1. In a rotatable cutter disk having first and second surfaces with a plurality of radially extending openings which extend outwardly relative to a center of the cutter disk and which openings define passageways through the disk from said first to said second surfaces for cut chips to pass from the first surface to the second surface of the disk, and wherein a knife holder is mounted adjacent each of the openings and the first surface of the disk, each knife holder including a carrier part and a clamping part with each carrier part including i) an outer surface adjacent to its associated opening below said first surface of the disk and forming part of the associated passageway and ii) an upper load bearing contact surface oriented toward the first surface of the cutter disk to engage a portion of a knife, and a knife mounted between the carrier part and the clamping part of each knife holder, the improvement comprising:

each knife including a first knife edge forming surface and a chip breaking surface associated with said first knife edge forming surface and extending at an angle thereto, said first knife edge forming surface and said chip breaking surface intersecting to define a cutting edge which, when the knife is mounted between the carrier part and the clamping part overlies one of the openings with said first knife edge forming surface located adjacent to the first surface of the cutter disk and the chip breaking surface extending from the cutting edge down into the passageway towards the outer surface of the carrier part, said chip breaking surface including a chip directing portion defined by a rib extending generally parallel to the cutting edge downstream of the first surface of the disk in the direction of chip flow in the passageway, said rib having i) said first chip directing portion which extends outwardly of the knife into the passageway of said one of the openings and downwardly in the direction of chip flow therein to a point which is located beyond the outer surface of the carrier part and below the point at which the outer surface of the carrier part intersects the upper load bearing surface of said carrier part in the direction of chip flow, and ii) a second, knife support, surface being oriented along a first plane which diverges outwardly from the knife away from the first surface of the cutter disk at a substantially acute angle to the first knife edge forming surface and first surface of the disk, away from a second plane defined by said first knife edge forming surface of the knife, and downwardly in the direction of chip flow in the passageway, such that said first and second planes intersect at a line that extends through a point located within the area of a projection of the knife onto said second plane and outside the area occupied by the knife, and the first and second surfaces of the rib intersect at an acute angle below the point at which the outer surface of the carrier part intersects the load bearing contact surface of the carrier part, with said second surface of said rib engaging the load bearing contact surface of the carrier part and an outer portion of the rib defined by the intersection of the rib surfaces being spaced in front of the outer surface of the carrier part, to direct cut chips in the passageway of said one of the openings in a direction away from the outer surface of the carrier part.

2. The rotatable cutter disk of claim 1 wherein said chip breaking surface includes a planar surface portion extending from said cutting edge to said chip directing portion.

3. The rotatable cutter disk of claim 2 in which each knife includes one of said cutting edges on opposite ends thereof each of which is oriented generally parallel to an elongated axis of each knife, one of said chip breaking surfaces on opposite ends thereof, each chip breaking surface including one of said chip directing portions defining one of said ribs, one of said chip breaking surfaces extending from each of said opposite cutting edges, and each knife being symmetrical on opposite sides of said elongated axis such that each knife may be reversed by a half turn about said elongated axis to selectively orient one of said opposite cutting edges with respect to said one of the openings of the cutter disk.

4. The rotatable cutter disk of claim 1 wherein each knife has two parallel contact surfaces which are engaged with the carrier part and the clamping part.

5. The rotatable cutter disk of claim 1 in which said chip directing portion is generally concave.

* * * * *